US006505543B2

(12) United States Patent
Maffeis

(10) Patent No.: US 6,505,543 B2
(45) Date of Patent: Jan. 14, 2003

(54) PNEUMATIC LINEAR ACTUATOR

(75) Inventor: Giuseppe Maffeis, Roncadelle (IT)

(73) Assignee: Gimatic S.p.A. (IT)

( * ) Notice: Subject to any disclaimer, the term of this patent is extended or adjusted under 35 U.S.C. 154(b) by 19 days.

(21) Appl. No.: 09/800,307

(22) Filed: Mar. 2, 2001

(65) Prior Publication Data

US 2002/0002901 A1 Jan. 10, 2002

(30) Foreign Application Priority Data

Jul. 10, 2000 (IT) ..... BS2000A000064

(51) Int. Cl.[7] ..... F01B 9/00
(52) U.S. Cl. ..... 92/137; 74/110; 474/148
(58) Field of Search ..... 92/137; 74/110; 474/148, 149, 150

(56) References Cited

U.S. PATENT DOCUMENTS

| | | | | | |
|---|---|---|---|---|---|
| 3,949,620 | A | * | 4/1976 | Zehnder | 74/110 |
| 4,235,421 | A | * | 11/1980 | Phillips | 74/110 |
| 4,718,293 | A | * | 1/1988 | Muta | 74/110 |
| 5,222,428 | A | * | 6/1993 | Janetzko et al. | 92/137 |

* cited by examiner

*Primary Examiner*—Edward K. Look
*Assistant Examiner*—Thomas E. Lazo
(74) *Attorney, Agent, or Firm*—McGlew and Tuttle, P.C.

(57) ABSTRACT

A pneumatic linear actuator has a body (10), a chamber (14) in the body that is closed by the end heads (15), a piston (11) that is arranged in the chamber and moved by a fluid sent alternately to the ends of the piston, and a slide or carriage (13) that is movable on the body driven by the piston. A belt (20) is driven on pulleys (19, 21, 22) and connects the piston to the slide, so that a stroke and a velocity at least twice that of the slide correspond to the stroke of the piston.

6 Claims, 3 Drawing Sheets

PNEUMATIC LINEAR ACTUATOR

FIELD OF THE INVENTION

The present invention pertains to the field of pneumatic-type linear actuators having a body, a chamber in said body that is closed by the end heads, a piston that is arranged in the chamber and is moved by a fluid that is sent alternately to the ends of the piston, and a slide or carriage movable on the body driven by the piston.

BACKGROUND OF THE INVENTION

Pneumatically actuated rodless cylinders and electric actuators have become known as linear actuators. Particularly, the rodless cylinders have a piston contained in a chamber, in which it slides moved by a fluid fed alternately to the opposite ends of the chamber. The piston drags a body, a carriage or slide, that protrudes on the outside of the chamber for the fixing of a device to be moved. The cylinder must thus be provided with a slot which extends along its generator and which must be closed for sealing by at least one sheet, usually made of metal. However, the slot is a source of air losses, which, combined with the wear of the sheet, limit the output and the life of the actuator.

SUMMARY AND OBJECTS OF THE INVENTION

One object of the present invention is to provide a pneumatic-type, and therefore simple and economical, linear actuator, which does not experience the drawbacks complained about above and which guarantees a better pneumatic sealing, a higher output, and a longer life compared with prior-art actuators.

Another object of the present invention is to provide a pneumatic linear actuator with a motion transmission system from the piston to the slide, which acts as a velocity multiplier and thus which makes it possible for the actuator to be able to be used even in fields in which high performances are required.

The said objects are accomplished with a pneumatic linear actuator of the type mentioned in the introduction, but having the feature of a belt transmitted on pulleys and connecting the piston to the slide, so that a stroke and velocity that are at least twice that of the slide correspond to the stroke of the piston.

In such an actuator, the air losses are practically nonexistent since the sliding chamber of the piston never communicates with the outside. Therefore, a pneumatic seal only on the piston, which can easily be obtained with usual and simple means, such as lip seals, is sufficient.

The control velocity obtainable with this actuator is, with operating conditions being equal, at least twice what can be achieved with the traditional rodless cylinders, in which the carriage is integral with the piston.

Moreover, the actuator proposed also guarantees a longer life, not having parts that can wear out rapidly.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
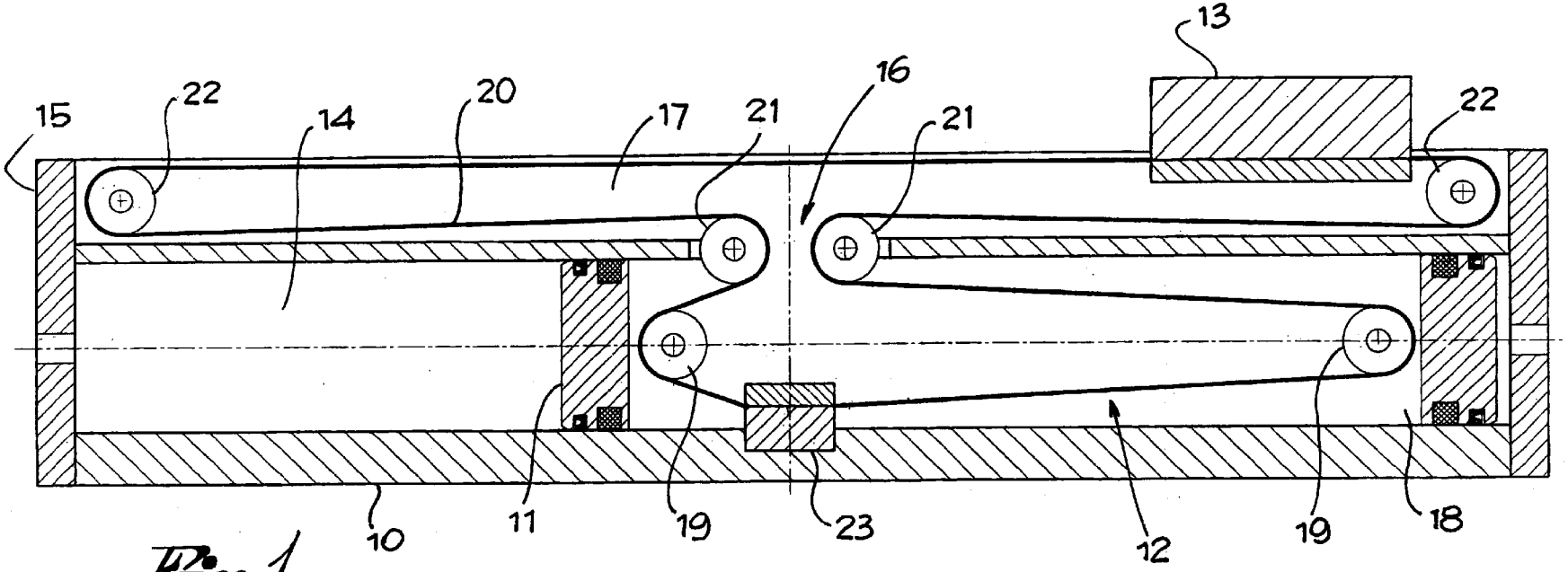
FIG. 1 is a sectional view of the pneumatic linear actuator according to the invention.
Figure 2:
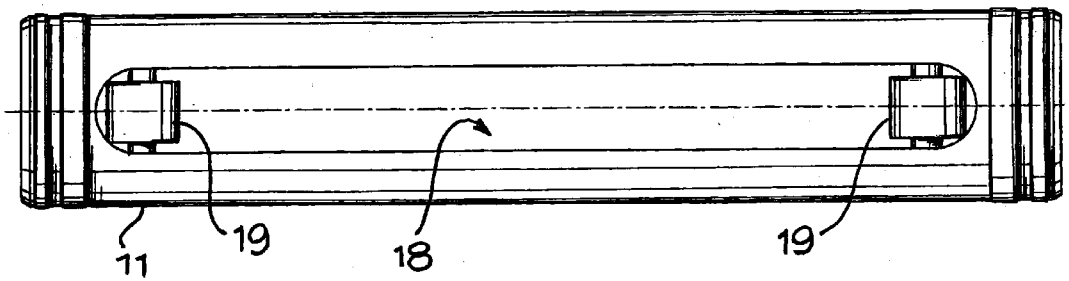
FIG. 2 is a top view of only the piston of the actuator.
Figure 3:
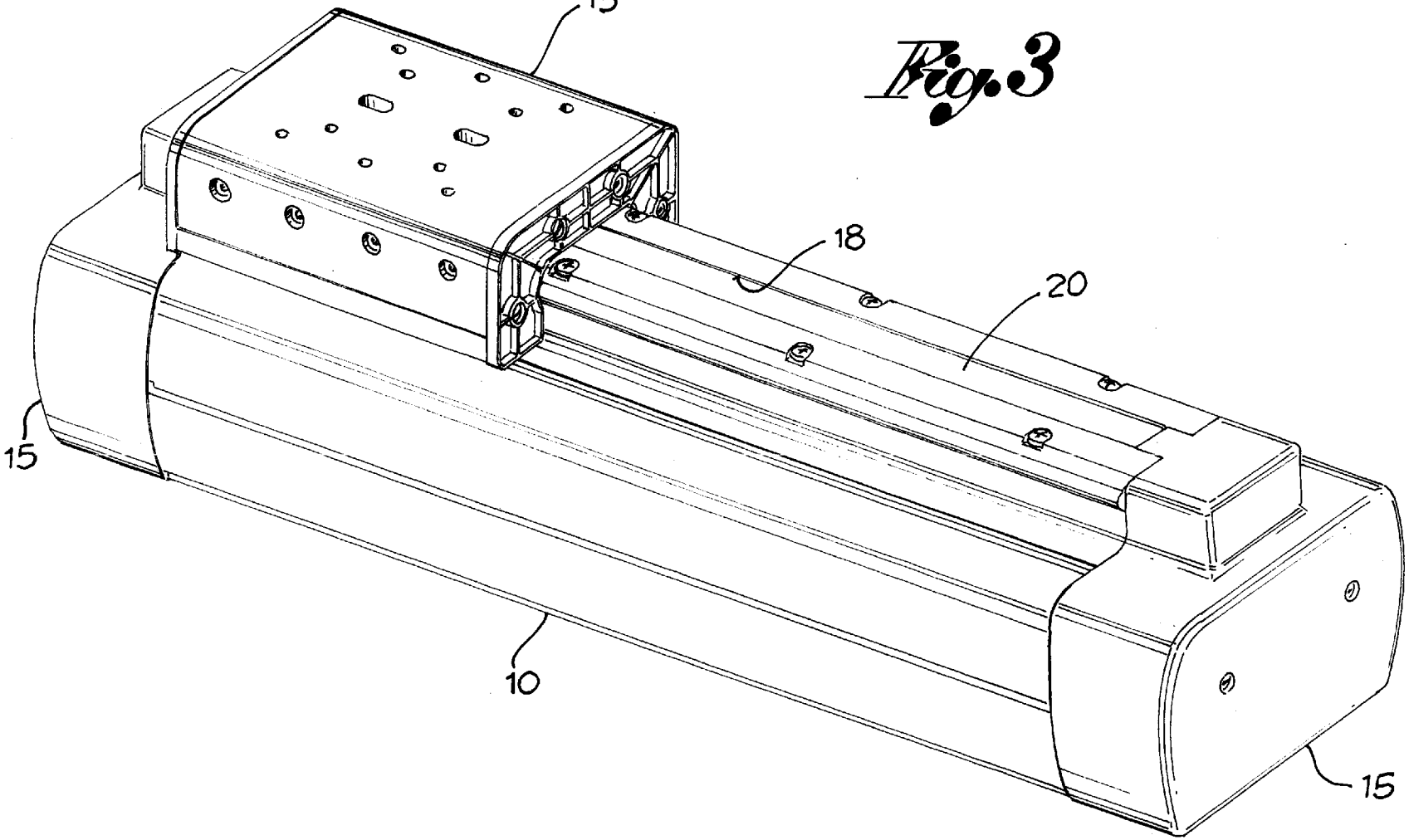
FIG. 3 is a perspective view of a configuration of the linear actuator according to the present invention.

Referring to the drawings in particular, a pneumatic linear actuator comprising a body 10, a piston 11, a transmission system 12 and a slide or carriage 13 is shown in the drawings.

The body 10 delimits a chamber 14 closed by the end heads 15. The piston 11 is arranged in the chamber 14. The piston 11 is moved by a fluid sent in the chamber alternately to the opposite ends of the piston. The chamber 14 has an intermediate lateral opening 16 towards a space 17 on the outside of the body.

The piston has an intermediate cavity in which are arranged two pulleys 19.

Figure 4:
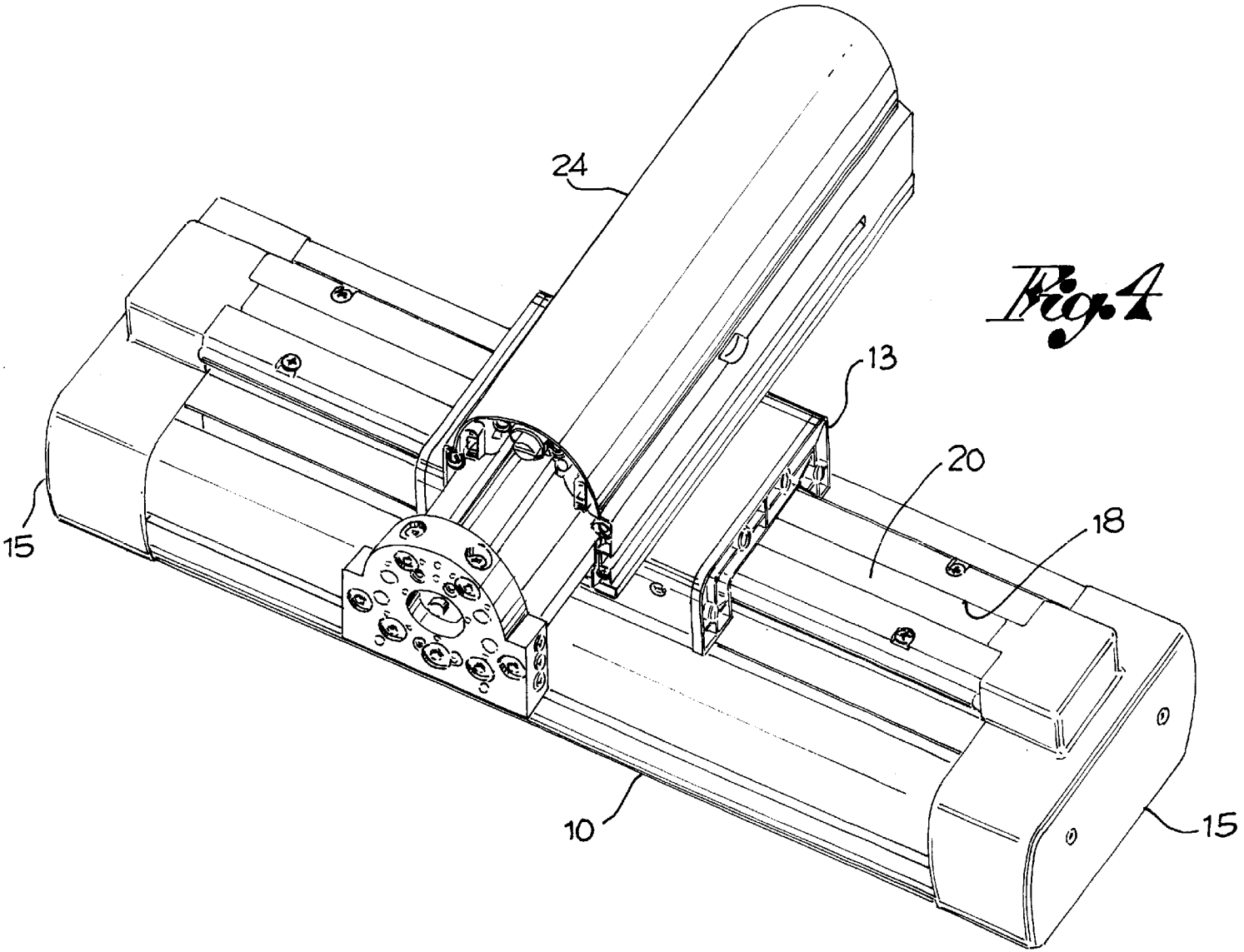
FIG. 4 is a perspective view of another configuration of the linear actuator according to the present invention.

The transmission system 12 is composed of a belt 20 transmitted on the pulleys 19 onboard the piston, as well as on two pulleys 21 at the lateral opening 16 and on another pair of pulleys 22, which are arranged in the external space 17. The branch of the belt contained between the pulleys 19 on the piston is fixed to the body at 23, and preferably in front of the opening 16. The carriage or slide 13, to which a device to be controlled 24 can be connected, is attached to the branch of the belt between the two pulleys 22 arranged in the external space (FIG. 4).

Therefore, a movement of the slide in the same direction corresponds to a movement of the piston, and, thanks to the particular transmission system, the stroke and velocity of the slide become twice that of the piston.

The position of the intermediate opening is such that the piston, during its stroke, never has to uncover this opening; therefore, the fluid chambers are never arranged in communication with the external space. This construction provides an inherent advantage in terms of pneumatic sealing.

While specific embodiments of the invention have been shown and described in detail to illustrate the application of the principles of the invention, it will be understood that the invention may be embodied otherwise without departing from such principles.

What is claimed is:

1. A pneumatic linear actuator, comprising:

a body with a chamber in said body;

end heads closing ends of said chamber;

a piston arranged in said chamber and moved by a fluid that is sent alternately to the ends of said piston;

a carriage movable on said body; and a driven transmission belt and pulleys supporting said belt, said belt connecting said piston to said slide or carriage so that a stroke and velocity of said slide or carriage is at least twice that of said piston for a stroke of said piston, said body having an intermediate lateral opening to said chamber towards a space outside said body, said piston having an intermediate piston cavity and said transmission belt being supported on a first pair of said pulleys, said first pair of pulleys being arranged in said piston cavity, and supported on a said second pair of pulleys at said intermediate lateral opening, said intermediate lateral opening being always contained between ends of said piston, and supported on a third pair of pulleys arranged in a space external to said cavity and fixed to said body, said lateral opening always being contained between the ends of the piston, regardless of the position of the piston in the chamber, the branch of said belt contained between said first pair of pulleys, said piston being fixed to said body inside said chamber and said slide being attached to a branch of the belt between said two pulleys arranged in said space.

2. A pneumatic linear actuator in accordance with claim 1, wherein a branch of said belt is fixed to said body between said first pair of pulleys on said piston at a location in front of an intermediate lateral opening.

3. A pneumatic linear actuator, comprising:

a body defining a chamber with end heads having fluid openings;

a piston arranged in said chamber between said fluid openings and movable in said chamber by a force of fluid admitted or withdrawn through said fluid openings;

a slide movable relative to said body; and a transmission connection between said piston and said slide for moving said slide upon movement of said piston at a ratio of movement whereby a velocity of said slide is at least twice that of a velocity of said piston.

4. A pneumatic linear actuator in accordance with claim 3, wherein:

said body has an intermediate lateral opening to said chamber towards a space outside said body; and said transmission connection comprises a belt an pulleys.

5. A pneumatic linear actuator in accordance with claim 4, wherein:

said piston has an intermediate piston cavity and said transmission belt is supported on a first pair of said pulleys, said first pair of pulleys being arranged in said piston cavity, and supported on a said second pair of pulleys at said intermediate lateral opening, said intermediate lateral opening being always contained between ends of said piston, and supported on a third pair of pulleys arranged in a space external to said cavity and fixed to said body, said lateral opening always being contained between the ends of the piston, regardless of the position of the piston in the chamber, the branch of said belt contained between said first pair of pulleys, said piston being fixed to said body inside said chamber and said slide being attached to a branch of the belt between said two pulleys arranged in said space.

6. A pneumatic linear actuator in accordance with claim 5, wherein a branch of said belt is fixed to said body between said first pair of pulleys on said piston at a location in front of an intermediate lateral opening.

* * * * *